US005950794A

United States Patent [19]

Porco et al.

[11] Patent Number: 5,950,794

[45] Date of Patent: Sep. 14, 1999

[54] COMBINATION COIN MECHANISM AND COIN COUNTER FOR BULK VENDING MACHINES

[75] Inventors: Elliott Porco, Bronx; Nikolay Nikolayev, Flushing, both of N.Y.

[73] Assignee: Nova Resolution Industries, Inc., Bronx, N.Y.

[21] Appl. No.: 08/842,677

[22] Filed: Apr. 15, 1997

[51] Int. Cl.[6] ..... G07F 11/44

[52] U.S. Cl. ..... 194/239; 194/255; 221/7

[58] Field of Search ..... 194/236, 237, 194/239, 243, 255, 292; 221/7; 453/32

[56] References Cited

U.S. PATENT DOCUMENTS

| | | | |
|---|---|---|---|
| 1,355,583 | 10/1920 | Zeidler | 221/7 X |
| 1,926,652 | 9/1933 | Rosenfeld | 194/243 X |
| 3,783,986 | 1/1974 | Bolen | 221/7 X |
| 4,143,749 | 3/1979 | Otten . | |
| 4,216,461 | 8/1980 | Werth et al. . | |
| 4,369,442 | 1/1983 | Werth et al. | 340/825.35 |
| 4,376,479 | 3/1983 | Sugimoto et al. | 221/2 X |
| 4,392,564 | 7/1983 | Hayashi . | |
| 5,174,427 | 12/1992 | Glaser | 194/236 |
| 5,201,396 | 4/1993 | Chalabian et al. | 194/217 |

*Primary Examiner*—F. J. Bartuska

*Attorney, Agent, or Firm*—Michael R. Gilman; Kaplan & Gilman, LLP

[57] ABSTRACT

An improved bulk vending machine coin mechanism and counter combination is provided. The combination coin mechanism and coin counter comprises a coin mechanism designed to be partially received into an opening in a bulk vending machine, having a selectively rotatable cam. The coin counter is attached to a portion of the coin mechanism inside of the bulk vending machine, and has a numeric display and a pivotally mounted switch connected to the display by at least one lead. A portion of the switch is in contact with the cam, which, due to its eccentric shape, causes the switch to pivot upon the rotation of the cam, causing the numeric display to advance one number for each full rotation of the cam.

19 Claims, 7 Drawing Sheets

COMBINATION COIN MECHANISM AND COIN COUNTER FOR BULK VENDING MACHINES

BACKGROUND OF THE INVENTION

This invention relates to the field of bulk vending machines, and more particularly, to a combination coin mechanism and coin counter for bulk vending machines.

Both vending machines and bulk vending machines are old in the art. Vending machines are normally associated with those machines used for dispensing a particularly chosen item to a user of the machine. For example, a user of a vending machine will insert the required amount of money, represented by coins or bills, into the machine and will then have an opportunity to select from a variety of different items. These items can include different types of snacks (candy bars, potato chips, pretzels, gum, breath mints, etc.), drinks (soda, fruit juices, water, etc.) and ice cream (sandwiches, pops, cones, etc.).

In contrast, a bulk vending machine does not normally lend itself to giving the user of a machine a choice between the goods to be selected. In general, bulk vending machines hold large quantities of a particular type of item (gum balls, nuts, trail mix, toys, balls, etc.) in a large top mounted receptacle. By placing a coin into the coin mechanism of the bulk vending machine, and turning the handle, one, or a handful, of the items within the receptacle are dispensed down a chute for receipt by the user. In these machines, no choice has been given to the user, and the user will receive whichever item, or items, are next in line to be dispensed. Parents will now clearly understand the distinction between vending machines and bulk vending machines; vending machines give their child a choice and the child walks away happy and content, while bulk vending machines distribute what they want to the awaiting hands of the child, and no matter how much screaming and ranting by the child, he/she will have to eat the blue gum ball, even though he/she really wanted a green gum ball.

Another important distinction between vending machines and bulk vending machines, is that vending machines are normally AC powered units which are plugged into a wall outlet, while bulk vending machines are almost never electrically powered. This makes bulk vending machines safer to use, and allows for their placement in any location.

In the history of the bulk vending industry, there has been no effective way of counting the money received into bulk vending machines. Today's standard methods for determining the amount of vends which have occurred, and the coins inserted into a given machine during a certain period of time, are by hand-held coin counters and weight scales. These methods make the collection process very time consuming and leave no hope for any sense of security, nor for the possibility of building any kind of financial history for the particular machine by the owner or lease holder of the machine.

As is evidenced by the counting mechanisms of U.S. Pat. Nos. 5,201,396, 4,392,563, 4,376,479, 4,369,442, 4,216,461 and 4,143,749, the prior art discloses attempts to insert counters, usually into vending machines, but sometimes into bulk vending machines. These prior art counters have the disadvantages of requiring a separate AC power source and the need of an associated power converter to provide the low voltage power needed to the meter. These prior art counters also disclose mechanisms having computers attached thereto, mechanisms for determining the value of the coins deposited, and mechanisms for counting the value of the items exiting the machine. All of these counters are hindered by deficiencies in size, power source and the complicated nature of their operation.

The bulk vending industry is crying out for a small, self powered (not requiring an external AC power source) counting mechanism for its bulk vending machines. Accordingly, it would be desirable to provide a combination coin mechanism and coin counter for a bulk vending machine which needs no external AC power source, is sized so as to fit within the restricted space limitations of a bulk vending machine, is accurate, is easily read and is not able to be tampered with.

SUMMARY OF THE INVENTION

In accordance with the invention, an improved bulk vending machine coin mechanism and counter combination is provided. The combination coin mechanism and coin counter comprises a coin mechanism designed to be partially received into an opening in a bulk vending machine, having a selectively rotatable cam. The coin counter is attached to a portion of the coin mechanism inside of the bulk vending machine, and has a numeric display and a pivotally mounted switch connected to the display by at least one lead. A portion of the switch is in contact with the cam, which, due to its eccentric shape, causes the switch to pivot upon the rotation of the cam, causing the numeric display to advance one number for each full rotation of the cam.

Accordingly, it is an object of the invention to provide an improved combination coin mechanism and coin counter for a bulk vending machine.

Still another object of the invention is to provide an improved counting mechanism for a bulk vending machine wherein the combination of the coin mechanism and the coin counter are designed to work together and fit within the limited space provided in a bulk vending machine.

Yet another object of the invention is to provide an improved combination coin mechanism and coin counter for a bulk vending machine which is not powered by an outside AC power source.

Still a further object of the invention is to provide security and peace of mind to the owner/lease holder of bulk vending machines by enabling them to have independent, accurate and non-tamperable results of the counting of coins deposited into a bulk vending machine.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
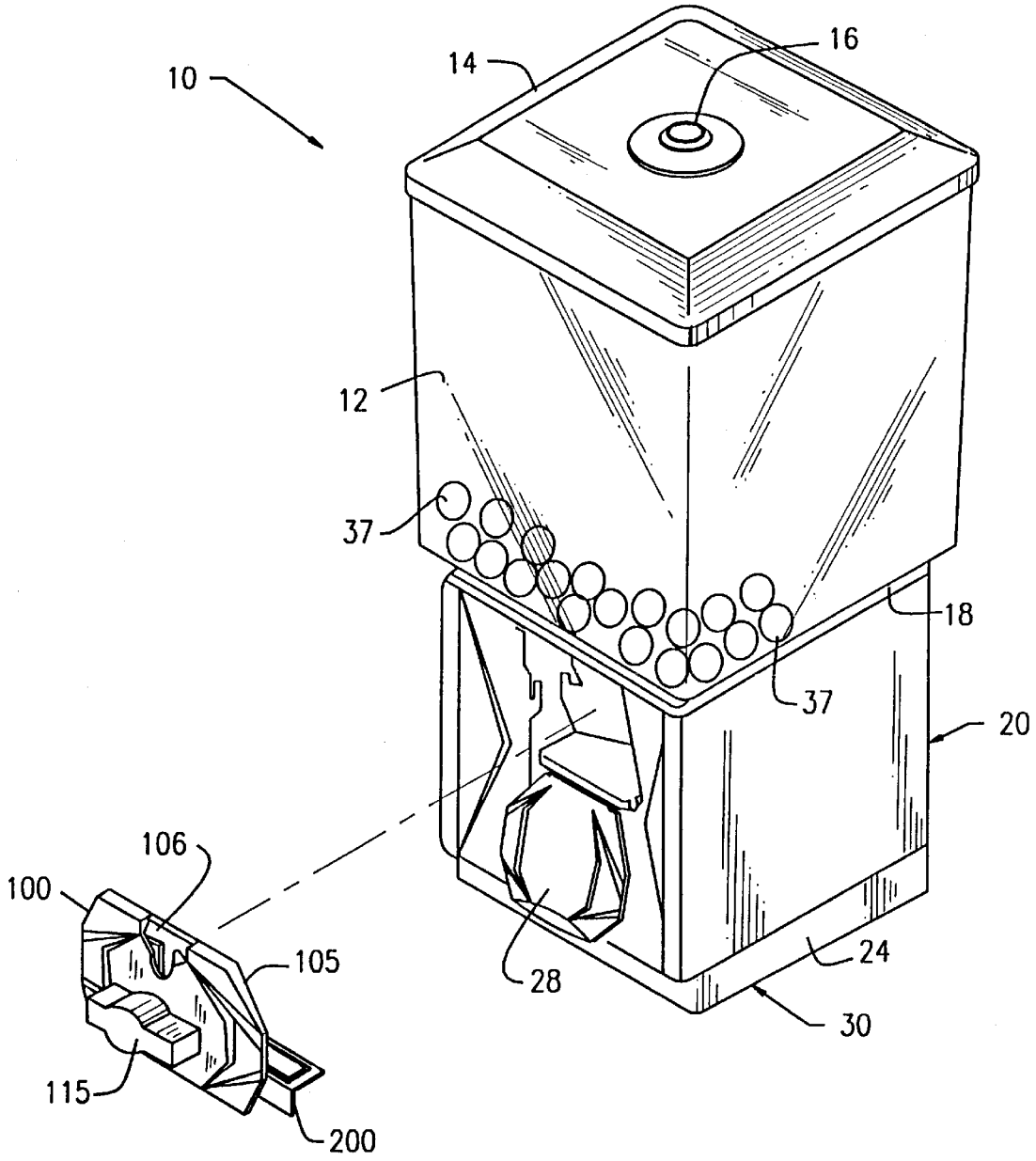
FIG. 1 is a perspective view of a bulk vending machine with an exploded view of the placement of the combination coin mechanism and coin counter.
Figure 2:
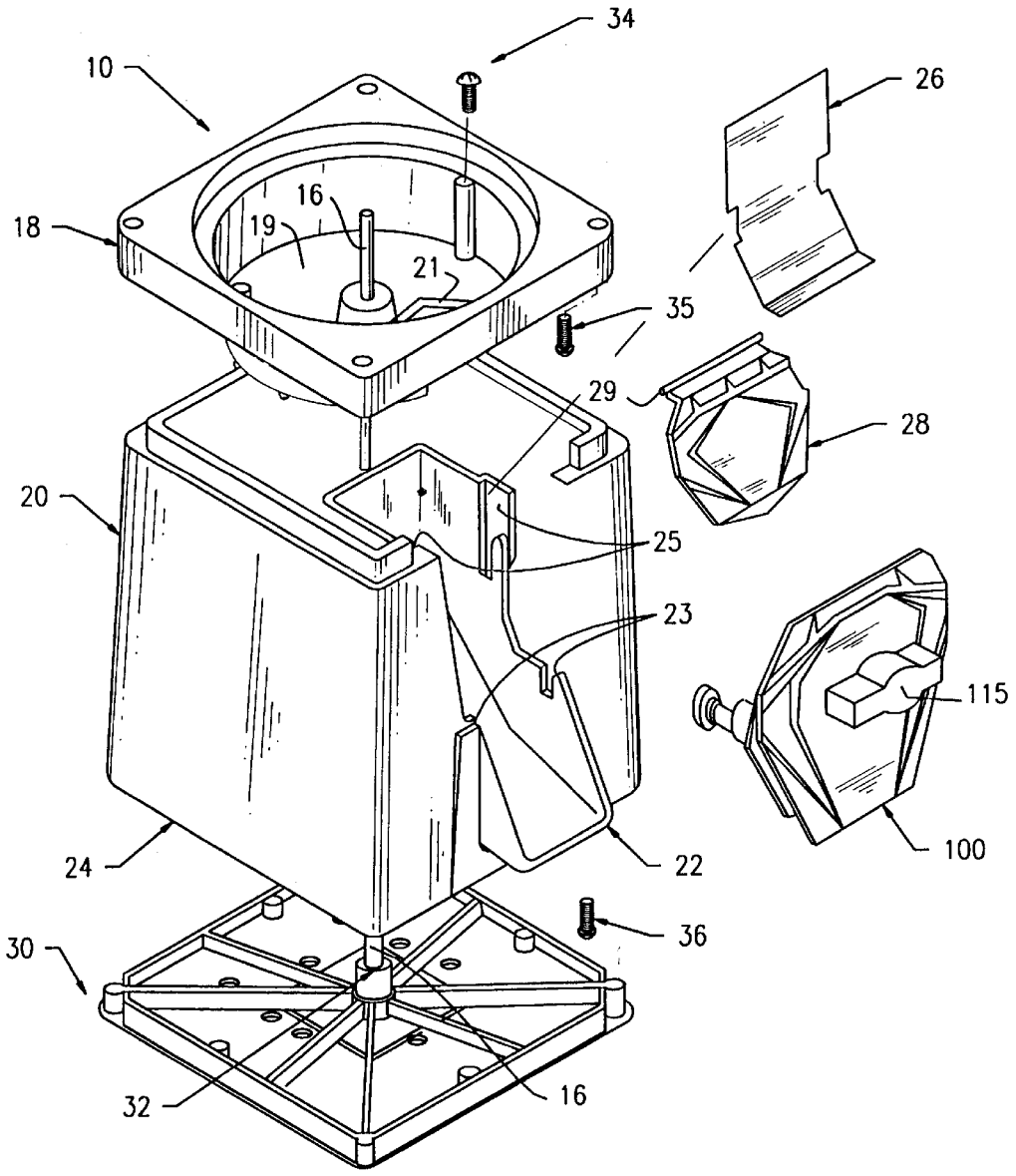
FIG. 2 is an exploded perspective view of a second embodiment of a bulk vending machine.

Referring first to FIGS. 1 and 2, two different, although very similar looking, bulk vending machines are shown at 10. Bulk vending machine 10 of FIG. 1 shows a fully constructed machine, having a top bulk receptacle 12 having a lid 14 and a bolt 16. The base of both machines 10 have a hopper 18, a body 20, a dispensing chute 22, a coin retainer base 24, a chute shield 26, a chute cover 28 and a coin mechanism 100.

In general, machine 10 has a base 30 into which bolt 16 extends to be secured by nut 32.

Receptacle 12 is held to hopper 18 by screws 34. Coin retainer 24 is held to the bottom of base 20 by screws 36. Chute shield 26 is secured onto chute 22 in notches 25, while chute cover 28 is rotatingly secured to chute 22 by rod 29 of cover 28 resting within notches 23 of chute 22.

Hopper 18 has a base 19 into which dispensing materials (for example, gum balls 37, see FIG. 1) are placed.

Hopper 18 has an opening 21 extending through base 19. opening 21 is the passageway through which gum balls 37 pass to exit machine 10 through chute 22. As will be discussed in more detail below with regard to FIG. 3, coin mechanism 100 has a sprocket 150, which when rotated due to a user of machine 10 turning handle 115 of coin mechanism 100, causes a product wheel (not shown) to rotate. The product wheel has at least one opening which for each rotation of handle 115 corresponds with opening 21 of hopper 18, to allow for dispensing of one gum ball 37, or multiple quantities of such items as nuts, trail mix, M&Ms, etc.

Figure 3:
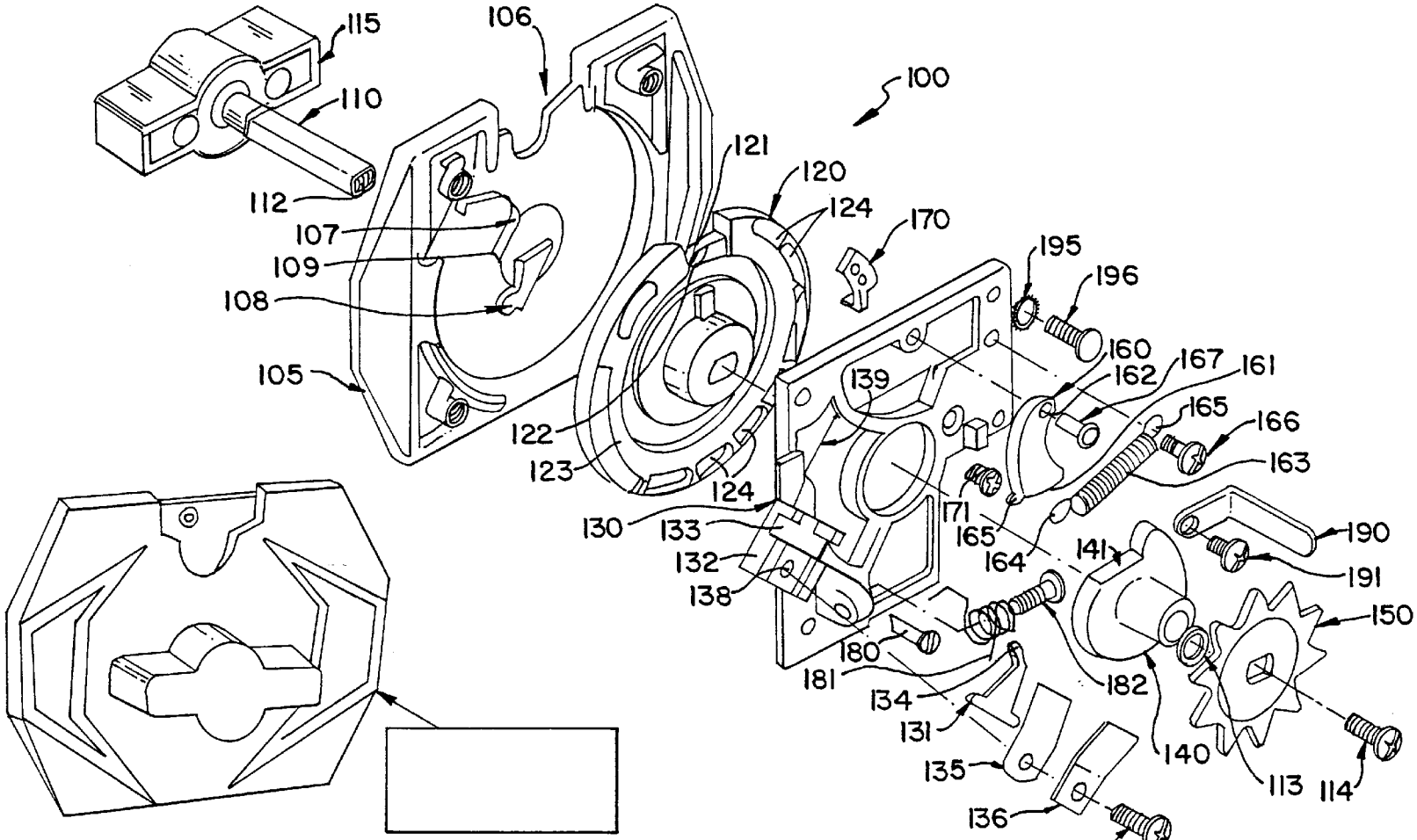
FIG. 3 is an exploded perspective view of the workings of a bulk vending machine coin mechanism.

Turning now to FIG. 3, an exploded view of a standard coin mechanism for a bulk vending machine is shown at 100. It is to be understood that the use of differently constructed coin mechanisms is anticipated by the invention.

Coin mechanism 100 has a front plate 105, shaft 110, handle 115, coin wheel 120, back plate 130, cam 140 and sprocket 150. Shaft 110 is axially located through all of the stated elements, and secures said elements together through use of threads 112 in shaft 110 and washer 113 and nut 114. At the end of shaft 110, opposite threads 112, is handle 115. As seen earlier in FIGS. 1 and 2, handle 115 is one of the few parts of coin mechanism 100 which is exterior to bulk vending machine 10, and is the part that a user of bulk vending machine 10 uses after insertion of coins to receive his/her treat.

Continuing with FIGS. 1 and 3, front plate 105 of coin mechanism 100 has a coin receiving slot 106. In use, a user of bulk vending machine 10 inserts a coin (usually a quarter) into slot 106 of front plate 105. Once the quarter is inserted through slot 106, it comes to rest within slot 121 of coin wheel 120 (see FIG. 3), where it sits upon curved ridge 122. In its position on curved ridge 122, a quarter will turn with coin wheel 120 when handle 115 is rotated. It is the positioning of a coin within coin wheel 120, which, based upon the size of the coin, will allow coin wheel 120 to freely rotate thereby allowing cam 130 to correspondingly rotate to activate counter 200 (see FIGS. 1 and 4–9) (to be discussed below).

In operation, coin mechanism 100 operates as follows:

1. As previously discussed, a coin is placed within slot 106 of front plate 105, to rest upon curved ridge 122 of slot 121 of coin wheel 120.
2. Handle 115 is rotated in a clockwise direction where the coin undergoes its first test of authenticity. The coin first comes into contact with coin pawl spring 107 and coin pawl 108. As coin wheel 120 is rotated, the coin pushes end 109 of coin pawl spring 107 upward. Assuming the coin has a proper diameter, end 109 of coin pawl spring 107 will sufficiently rise, thereby disengaging coin pawl 108 from locking coin wheel 120 in position. Coin wheel 120 will thereafter be free to continue its clockward rotation.
3. The coin next encounters washer pawl 131, which is secured within washer pawl mount 132, having a receiving notch 133.

Washer pawl 131 is held within slot 133 of mount 132 by washer pawl spring 135, washer pawl retainer 136 and washer pawl retainer screw 137. Washer pawl retainer screw 137 screws into mount 132 at threaded opening 138. When secured in place, washer pawl 131 has its end 134 extending through opening 139 of back plate 130. While coin pawl 108 was responsible for authenticating the diameter of the coin, washer pawl 131 is the item which authenticates the thickness of the coin.

In operation, end 134 of washer pawl 131 runs against inside surface 123 of coin wheel 120. As can be seen at slot 121, with no coin in coin mechanism 100 (if for some reason coin wheel 120 somehow turned passed coin pawl 108), coin wheel 120 would be prevented from turning further due to end 134 of washer pawl 131 entering into slot 121 of coin wheel 120. In this position, slot 121 would hit against end 134, causing coin wheel 120 to halt in its rotation. Similarly, if the thickness of the coin was too thin, end 134 would slide off of surface 123 down to the surface of the coin, and would again touch part of slot 121, preventing further rotation of coin wheel 120. In contrast, if the coin were too thick, end 134 of washer pawl 131 would hit into the edge of the coin, and coin wheel 120 would at that point be prevented from rotating further. Only when the coin is of the proper thickness, will end 134 run smoothly between surface 123 and the surface of the coin, thereby allowing coin wheel 120 to continue its rotation.

4. The final pawl of coin mechanism 100 is return pawl 160. Return pawl 160 has a bottom side 161 and a substantially curved side 162. When cam 140 is in its resting position (between uses), it is the position shown in FIGS. 3 and 8. In this position, surface 161 of return pawl 160 rests upon flat surface 141 of cam 140.

Figure 8:
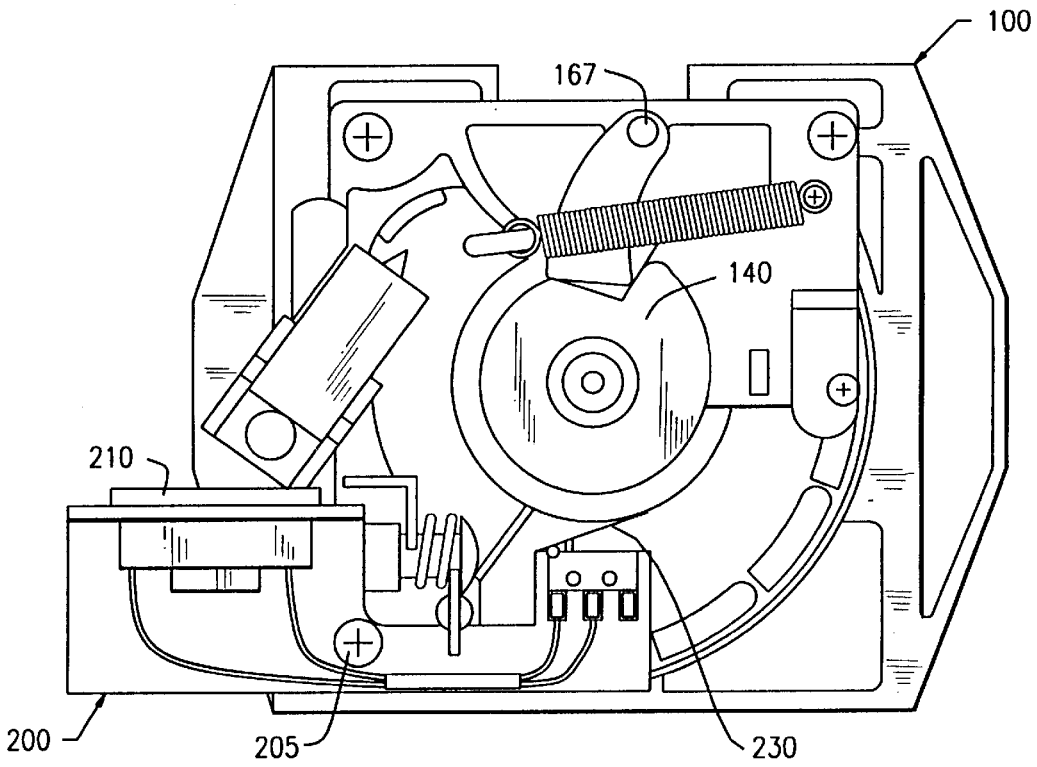
FIG. 8 is a back elevational view of the combination coin mechanism and coin counter of FIG. 6, without the sprocket and showing the cam in its at rest position.

Return pawl 160 is pulled into its at rest position shown in FIGS. 3 and 8 by spring 163 having first and second loops 164 and 165. Loop 164 is received around protrusion 165 of return pawl 160, and spring 163 is secured to back plate 130 by screw 166. Accordingly, tension from spring 163 maintains return pawl 160 in its at rest position, as shown in FIG. 8.

Return pawl 160 is riveted into back plate 130 by return pawl rivet 167, to enable return pawl 160 to pivot.

5. Attached at the end of shaft 110, between cam 140 and bolt 114, is sprocket 150, which as previously discussed, turns the product wheel (not shown) which allows for the dropping of treats, such as gum balls 37, from receptacle 12 of bulk vending machine 10 into chute 22 for receipt by a user of machine 10.
6. Continuing with the progress of the coin as coin wheel 120 rotates, after the coin passes washer pawl 131, coin wheel 120 is easily turned until slot 121 is in its starting position aligned with slot 106. It is in this position where return pawl 160 and cam 140 are in their at rest position, as previously discussed.

However, prior to coin wheel 120 being returned to its starting point, the coin is deflected by coin kickout 170 out from slot 121 and into coin retainer 24. Coin kickout 170 is secured to back plate 130 through use of screw 171.

Some final notes regarding the structure of coin mechanism 100, as shown in FIG. 3. First, coin wheel 120 has a plurality of notches 124 into which stroke pin 180 are received. The purpose of notches 124 and stroke pin 180 is to prevent coin wheel 120 from being turned counter-clockwise, so that the user can retrieve his/her coin. In particular, you will note that the bottom surfaces of notches 124 are slanted. Accordingly, it is obvious that stroke pin 180 will slide out from notches 124 along the bottoms of notches 124, from one notch to the next as coin wheel 120 is rotated in a clockwise direction. However, it is equally obvious that stroke pin 180 will hit against the ridges of notches 124, should the user attempt to rotate coin wheel 120 in a counter-clockwise direction.

Stroke pin 180 is held in place through a slot (not shown) in back plate 130 by a spring 181 and screw 182.

Next regarding FIG. 3., coin mechanism 100 is retained within body 20 of bulk vending machine 10 by use of latch 190, which is secured to back plate 130 by a screw 191. Latch 190 is selectively rotatable from its locked position (shown in FIG. 3) to an unlocked position, 90° from the position shown in FIG. 3.

Finally for FIG. 3, front plate 105 and back plate 130 are secured together through use of washers and bolts 195 and 196.

Figure 4:
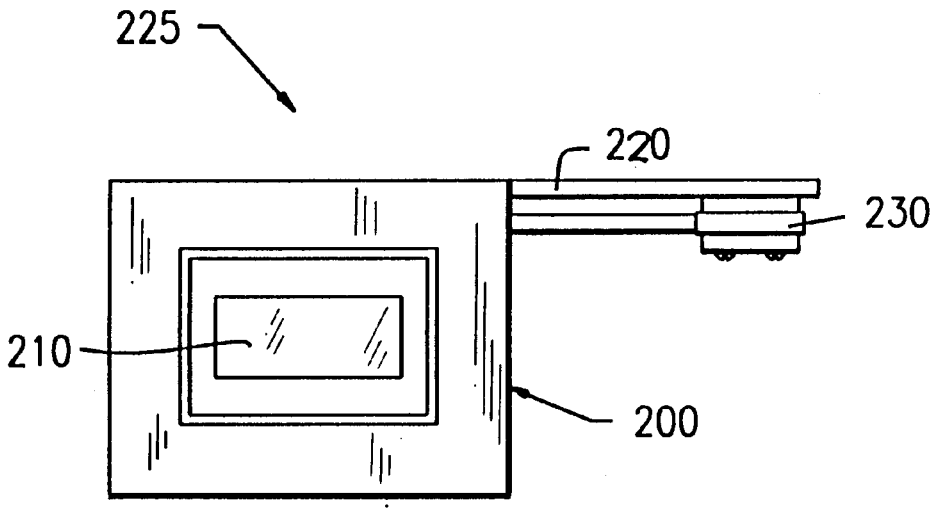
FIG. 4 is a top plan view of a counter made in accordance with the invention.
Figure 5:
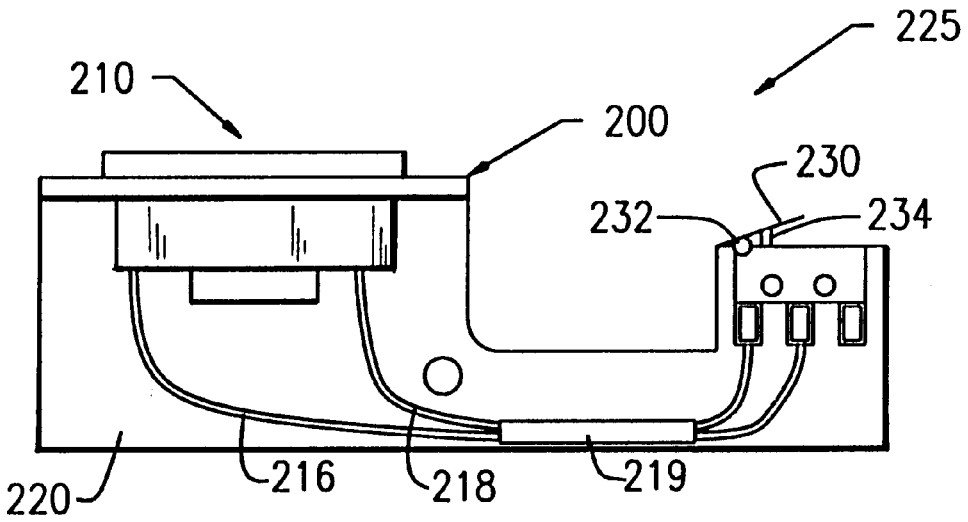
FIG. 5 is a front elevational view of the counter of FIG. 4.

We turn now to a discussion of counter 200 (as seen in FIGS. 4 and 5), and to how counter 200 is attached to coin mechanism 100 (as seen in FIGS. 6–9). Coin counter 200 has a numeric display 210, which is preferably an LCD display. Display 210 is mounted on a bracket 220, as are leads 216 and 218, and as is switch 230.

Leads 216 and 218 are at one point secured within a tubular member 219, so to help keep them from separating.

Bracket 220 is a specially designed and configured to fit onto coin mechanism 100, at back plate 130 without interfering or in any way hindering the standard operation of coin mechanism 100. In fact, bracket 220 and therefore counter 200, is so desinged as to allow switch 230 to interact with cam 140 during cam 140's normal operation.

Switch 225 comprises lever 230, pivot connection 232 and button 234.

Lever 230 is pivotally mounted around connection 232, and rests upon bottom 234. It is when button 234 is depressed and then released that counter 210 advances one number.

Figure 9:
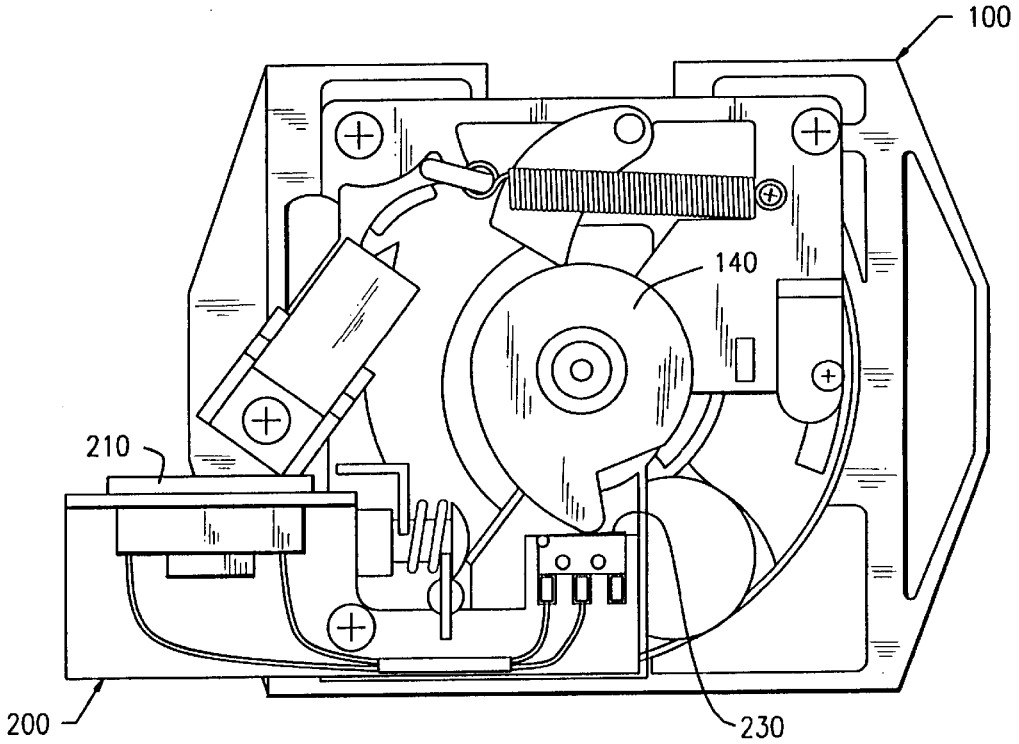
FIG. 9 is a rear elevational view of the combination coin mechanism and coin counter of FIG. 6, without the sprocket and showing the cam activating the switch of the counter.

Lever 230 depresses button 234 when coin wheel 120 is rotated due to rotation of handle 115, and simultaneous rotation of cam 140. FIGS. 8 and 9, in addition to showing how counter 200 is attached to back plate 130 by screw 205, show movement of cam 140 from its at rest position in FIG. 8, to its position of depressing lever 230, as shown in FIG. 9.

Figure 6:
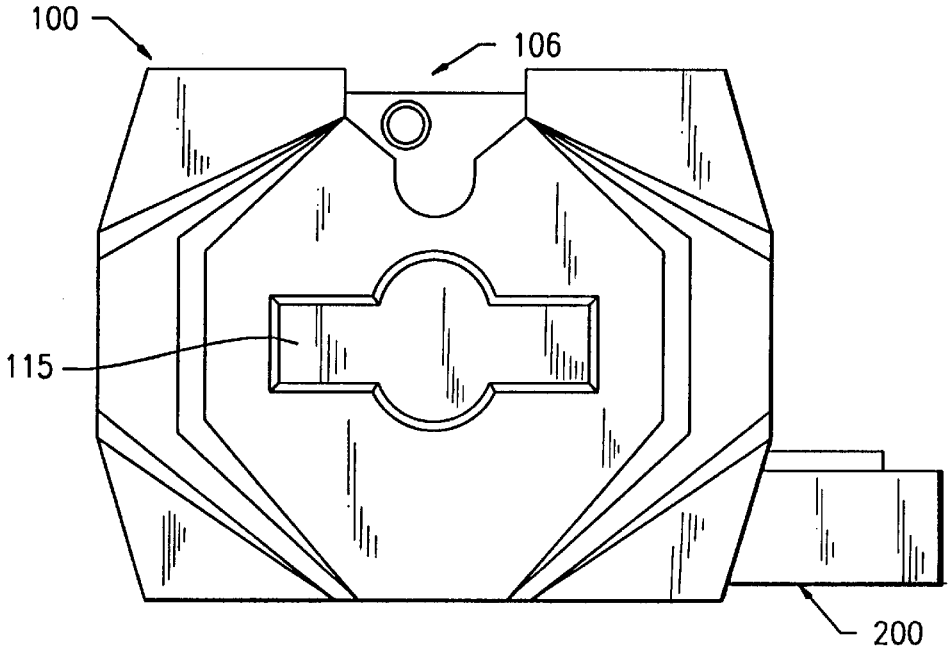
FIG. 6 is a front elevational view of the coin mechanism of FIG. 3, showing the counter of FIGS. 4 and 5 extending therefrom.
Figure 7:
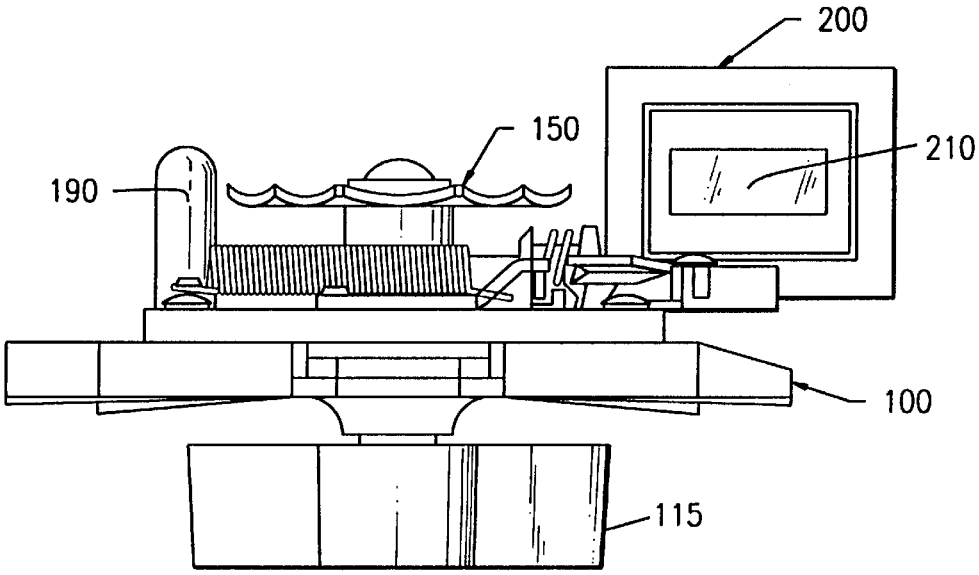
FIG. 7 is a top plan view of the combination coin mechanism and coin counter of FIG. 6.

As seen in FIGS. 1, 6 and 7, the combination coin mechanism 100 and coin counter 200 is substantially equivalent in size to the coin mechanism 100 by itself. In this way, counter 200 is able to be used within all bulk vending machines, in the limited space provided within body 20, between chute shield 26 and rear plate 130.

Since counter 200 is also self-powered by, preferably, a nickel cadmium battery, there is no need to have to position bulk vending machine 10 near an AC power outlet, and the bulk vending industry can continue its practice of positioning these bulk vending machines at inconvenient locations. The lack of an AC power hook-up to power counter 200 also increases the safety of the apparatus, since there is no possibility of electric shock to the users of the bulk vending machines.

Counter 200 is also positioned and oriented so as to be easily readable during normal collection procedures for bulk vending machines.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. For a bulk vending machine, a combination coin mechanism and coin counter, comprising:

a coin mechanism designed to be partially received into an opening in said bulk vending machine, said coin mechanism comprising a plate and a selectively rotatable cam mounted proximate to said plate on said coin mechanism; and a coin counter attached to said plate of said coin mechanism within said opening of said bulk vending machine, comprising:

a numeric display; and a switch connected to said display by at least one lead;

wherein said counter is attached to said mechanism in such a way that a portion of said switch is contacted by a portion of said cam, when said cam rotates, causing said switch to pivot thereby causing said numeric display to advance one number for each full rotation of said cam.

2. A combination coin mechanism and coin counter as recited in claim 1, said coin mechanism further comprising an externally accessible coin slot for receipt of a coin into said opening of said bulk vending machine.

3. A combination coin mechanism and coin counter as recited in claim 2, said coin mechanism further comprising a substantially axially mounted shaft having a handle extending from a first end thereof and said cam mounted therearound at a second end thereof.

4. A combination coin mechanism and coin counter as recited in claim 3, said coin mechanism further comprising a coin carrying assembly in working relation with said coin slot and mounted around said shaft, for carrying said coin within said opening of said bulk vending machine from said coin slot to a coin receptacle substantially below said opening of said bulk vending machine.

5. A combination coin mechanism and coin counter as recited in claim 4, wherein after said coin is inserted into said slot by a user of said mechanism, said coin travels within said mechanism in said carrying assembly in a substantially circular arch by the turning of said handle by said user, which action also turns said cam.

6. A combination coin mechanism and coin counter as recited in claim 1, wherein said counter is self-powered by a battery attached to said counter and located within said opening of said bulk vending machine.

7. A combination coin mechanism and coin counter as recited in claim 1, said switch comprising a selectively pivotal lever and a button to be depressed by said lever.

8. For a bulk vending machine having limited space therein for receipt, manipulation and deposit of coins, a combination coin mechanism and coin counter, comprising:

a coin mechanism designed to be partially received into an opening in said bulk vending machine, said coin mechanism comprising a plate and a selectively rotatable cam mounted proximate to said plate on said coin mechanism; and a coin counter attached to said plate of said coin mechanism within said opening of said bulk vending machine, comprising:

a numeric display; and a switch connected to said display by at least one lead;

wherein said counter is attached to said mechanism in such a way that a portion of said switch is contacted by a portion of said cam, when said cam rotates, causing said switch to pivot thereby causing said numeric display to advance one number for each full rotation of said cam.

9. A combination coin mechanism and coin counter as recited in claim 8, said coin mechanism further comprising an externally accessible coin slot for receipt of a coin into said opening of said bulk vending machine.

10. A combination coin mechanism and coin counter as recited in claim 9, said coin mechanism further comprising a substantially axially mounted shaft having a handle extending from a first end thereof and said cam mounted therearound at a second end thereof.

11. A combination coin mechanism and coin counter as recited in claim 10, said coin mechanism further comprising a coin carrying assembly in working relation with said coin slot and mounted around said shaft, for carrying said coin within said opening of said bulk vending machine from said coin slot to a coin receptacle substantially below said opening of said bulk vending machine.

12. A combination coin mechanism and coin counter as recited in claim 11, wherein after said coin is inserted into said slot by a user of said mechanism, said coin travels within said mechanism in said carrying assembly in a substantially circular arch by the turning of said handle by said user, which action also turns said cam.

13. A combination coin mechanism and coin counter as recited in claim 8, wherein said counter is self-powered by a battery attached to said counter and located within said opening of said bulk vending machine.

14. For a free standing, non-electrically powered bulk vending machine having limited space therein for receipt, manipulation and deposit of coins, a combination coin mechanism and coin counter, comprising:

a coin mechanism designed to be partially received into an opening in said bulk vending machine, said coin mechanism comprising a plate and a selectively rotatable cam mounted proximate to said plate on said coin mechanism; and a coin counter attached to said plate of said coin mechanism within said opening of said bulk vending machine, comprising:

a numeric display; and a switch connected to said display by at least one lead;

wherein said counter is attached to said mechanism in such a way that a portion of said switch is contacted by a portion of said cam, when said cam rotates, causing said switch to pivot thereby causing said numeric display to advance one number for each full rotation of said cam.

15. A combination coin mechanism and coin counter as recited in claim 14, said coin mechanism further comprising an externally accessible coin slot for receipt of a coin into said opening of said bulk vending machine.

16. A combination coin mechanism and coin counter as recited in claim 15, said coin mechanism further comprising a substantially axially mounted shaft having a handle extending from a first end thereof and said cam mounted therearound at a second end thereof.

17. A combination coin mechanism and coin counter as recited in claim 16, said coin mechanism further comprising a coin carrying assembly in working relation with said coin slot and mounted around said shaft, for carrying said coin within said opening of said bulk vending machine from said coin slot to a coin receptacle substantially below said opening of said bulk vending machine.

18. A combination coin mechanism and coin counter as recited in claim 17, wherein after said coin is inserted into said slot by a user of said mechanism, said coin travels within said mechanism in said carrying assembly in a substantially circular arch by the turning of said handle by said user, which action also turns said cam.

19. A combination coin mechanism and coin counter as recited in claim 14, wherein said counter is self-powered by a battery attached to said counter and located within said opening of said bulk vending machine.

* * * * *